US010207723B2

(12) United States Patent
Hyde et al.

(10) Patent No.: US 10,207,723 B2
(45) Date of Patent: Feb. 19, 2019

(54) TRAIN SUSPENSION CONTROL SYSTEMS AND METHODS

(71) Applicant: Elwha LLC, Bellevue, WA (US)

(72) Inventors: Roderick A. Hyde, Redmond, WA (US); Jordin T. Kare, San Jose, CA (US); Lowell L. Wood, Jr., Bellvue, WA (US)

(73) Assignee: Elwha LLC, Bellevue, WA (US)

( * ) Notice: Subject to any disclaimer, the term of this patent is extended or adjusted under 35 U.S.C. 154(b) by 546 days.

(21) Appl. No.: 14/626,669

(22) Filed: Feb. 19, 2015

(65) Prior Publication Data

US 2016/0244076 A1 Aug. 25, 2016

(51) Int. Cl.

| | |
|---|---|
| ***B61F 99/00*** | (2006.01) |
| ***B61F 5/04*** | (2006.01) |
| ***B61L 23/04*** | (2006.01) |
| ***B61L 25/02*** | (2006.01) |

(52) U.S. Cl.

CPC ..... *B61F 99/00* (2013.01); *B61F 5/04* (2013.01); *B61L 23/042* (2013.01); *B61L 23/044* (2013.01); *B61L 23/047* (2013.01); *B61L 25/025* (2013.01)

(58) Field of Classification Search

None

See application file for complete search history.

(56) References Cited

U.S. PATENT DOCUMENTS

| | | | | |
|---|---|---|---|---|
| 4,765,649 | A * | 8/1988 | Ikemoto | B60G 17/0162 280/5.506 |
| 7,616,329 | B2 | 11/2009 | Villar et al. | |
| 7,755,660 | B2 | 7/2010 | Nejikovsky et al. | |
| 8,412,393 | B2 | 4/2013 | Anderson et al. | |
| 2004/0263624 | A1 | 12/2004 | Nejikovsky et al. | |
| 2005/0090956 | A1* | 4/2005 | Ogawa | B60G 17/08 701/37 |
| 2006/0017911 | A1 | 1/2006 | Villar et al. | |
| 2007/0203621 | A1 | 8/2007 | Haugen et al. | |
| 2010/0004804 | A1 | 1/2010 | Anderson et al. | |
| 2010/0213321 | A1 | 8/2010 | Kane et al. | |
| 2013/0191070 | A1* | 7/2013 | Kainer | B61K 9/08 702/167 |

* cited by examiner

*Primary Examiner* — Jelani A Smith
*Assistant Examiner* — Paul A Castro
(74) *Attorney, Agent, or Firm* — Foley & Lardner LLP

(57) ABSTRACT

A suspension system for a railway vehicle includes a hub assembly configured to travel along a track, a suspension element coupled to the hub assembly and configured to provide a suspension force, a regulator coupled to the suspension element and configured to selectively adjust the suspension element, and a processing circuit. The processing circuit is configured to determine a target configuration for the suspension element using a characteristic of the track at a target position, the target position selected based on a location of the railway vehicle, and engage the regulator based on the target configuration such that the suspension force applied by the suspension element is based on the location of the railway vehicle and the characteristic of the track.

35 Claims, 8 Drawing Sheets

TRAIN SUSPENSION CONTROL SYSTEMS AND METHODS

BACKGROUND

Trains travel along tracks that may include one or more rails arranged generally parallel with one another. Such trains may include locomotives, passenger cars, freight cars, or still other types of railway vehicles. The railway vehicles traditionally have wheels that maintain rolling engagement with the rails of the track. Because the wheels maintain rolling engagement with the rails of the track, inconsistencies within the track may be communicated to passengers or freight supported by the railway vehicle. A suspension system may at least partially isolate passengers or freight from inconsistencies within the track. The suspension system may be disposed between the wheels and a chassis of the railway vehicle that supports the passengers or freight. Traditional suspension systems have characteristics (e.g., suspension rates, etc.) that remain fixed while the train is in motion. Such characteristics are often set or established in response to the largest inconsistencies of the track, thereby providing a suspension system having a suspension rate or other characteristic that is overdesigned for most operation.

SUMMARY

One embodiment relates to a suspension system for a railway vehicle that includes a hub assembly configured to travel along a track, a suspension element coupled to the hub assembly and configured to provide a suspension force, a regulator coupled to the suspension element and configured to selectively adjust the suspension element, and a processing circuit. The processing circuit is configured to determine a target configuration for the suspension element using a characteristic of the track at a target position, the target position selected based on a location of the railway vehicle, and engage the regulator based on the target configuration such that the suspension force applied by the suspension element is based on the location of the railway vehicle and the characteristic of the track.

Another embodiment relates to a railway vehicle that includes a chassis and a suspension system. The suspension system includes a hub assembly configured to travel along a track, a suspension element coupling the hub assembly to the chassis and configured to provide a suspension force, a regulator coupled to the suspension element and configured to selectively adjust the suspension element, and a processing circuit. The processing circuit is configured to determine a target configuration for the suspension element using a characteristic of the track at a target position, the target position selected based on a location of the railway vehicle, and engage the regulator based on the target configuration such that the suspension force applied by the suspension element is determined based on the location of the railway vehicle and the characteristic of the track.

Still another embodiment relates to a railway vehicle that includes a chassis and a suspension system. The suspension system includes a hub assembly configured to travel along a track, a suspension element coupling the hub assembly to the chassis, an actuator configured to selectively engage at least one of the chassis and the suspension element, and a processing circuit. The processing circuit is configured to determine a target actuation profile for the chassis using a characteristic of the track at a target position, the target position selected based on a location of the railway vehicle, and engage the actuator based on the target actuation profile such that the movement of the chassis is controlled based on the location of the railway vehicle and the characteristic of the track.

Yet another embodiment relates to a train that includes a first railway vehicle having a first hub assembly configured to travel along a track and a second railway vehicle having a chassis and a suspension system. The suspension system includes a second hub assembly configured to travel along the track, a suspension element coupling the hub assembly to the chassis and configured to provide a suspension force, a regulator coupled to the suspension element and configured to selectively adjust the suspension element, and a processing circuit. The processing circuit is configured to determine a target configuration for the suspension element using a characteristic of the track at a target position, the target position selected based on a location of the second hub assembly, and engage the regulator based on the target configuration such that the suspension force applied by the suspension element is determined based on the location of the second railway vehicle and the characteristic of the track.

Another embodiment relates to a train that includes a railway vehicle configured to travel along a track, an inspection system including a sensor positioned to measure a compliance of the track at a target position, and a processing circuit. The processing circuit is configured to associate the compliance of the track with the target position and record the compliance of the track on a location-dependent basis within a memory.

Still another embodiment relates to a method of actively controlling a suspension system of a railway vehicle. The method includes providing a hub assembly configured to travel along a track, providing a suspension force with a suspension element coupled to the hub assembly, positioning a regulator to selectively adjust the suspension element, determining a target configuration for the suspension element using a characteristic of the track at a target position, the target position selected based on a location of the railway vehicle, and placing the suspension element into the target configuration to vary the suspension force based on the location of the railway vehicle and the characteristic of the track.

Yet another embodiment relates to a method of operating a railway vehicle that includes providing a hub assembly configured to travel along a track, providing a suspension element coupling the hub assembly to a chassis, selectively engaging at least one of the chassis and the suspension element with an actuator, determining a target actuation profile for the chassis using a characteristic of the track at a target position, the target position selected based on a location of the railway vehicle, and engaging the actuator based on the target actuation profile such that the movement of the chassis is controlled based on the location of the railway vehicle and the characteristic of the track.

Another embodiment relates to a method of monitoring a track that includes monitoring movement of a railway vehicle along the track, measuring a compliance of the track at a target position with an inspection system that includes a sensor, associating the compliance of the track with the target position, and recording the compliance of the track on a location-dependent basis within a memory.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The invention will become more fully understood from the following detailed description taken in conjunction with the accompanying drawings wherein like reference numerals refer to like elements, in which.

DETAILED DESCRIPTION

Figure 1:
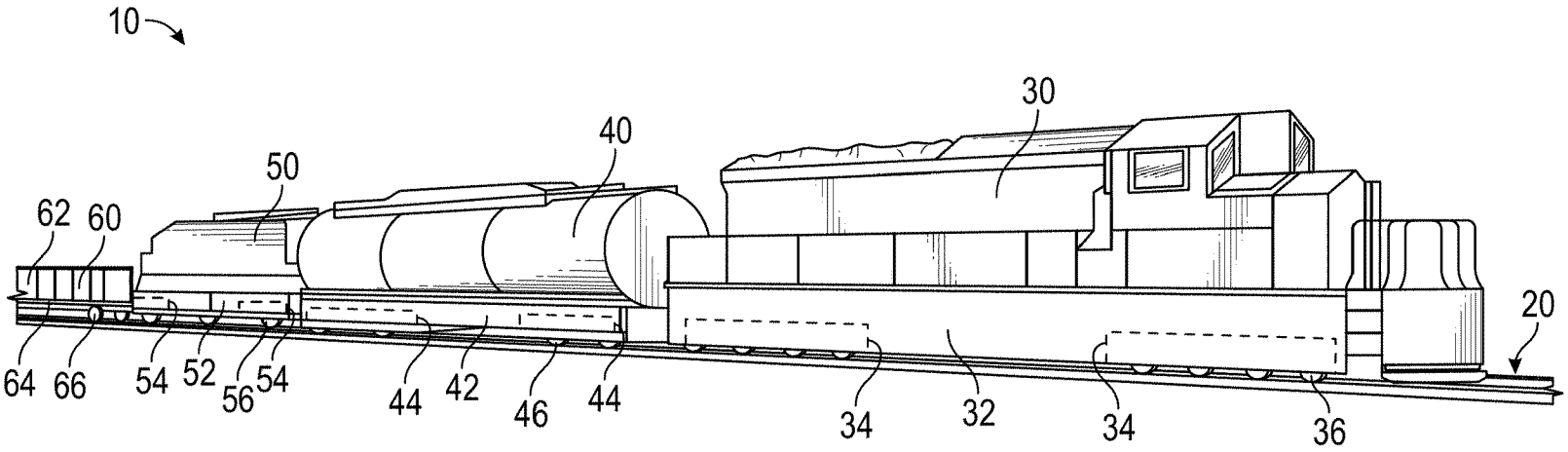
FIG. 1 is a perspective view of a train including a plurality of railway vehicles, according to one embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

According to one embodiment, a train includes at least one railway vehicle having an active suspension system. In one embodiment, the railway vehicle includes at least one of a locomotive, a passenger rail car, and a freight car. In other embodiments, the railway vehicle includes still another type of vehicle configured to travel along the track (e.g., an inspection vehicle, a test vehicle, etc.). The active suspension system of the railway vehicle may be controlled based on a characteristic of the track upon which the train travels. Controlling the active suspension system based on the characteristic of the track (e.g., using a value or other data relating to the characteristic, etc.) reduces the loading experienced by the chassis of the railway vehicle. Controlling the active suspension system based on the characteristic of the track may also facilitate faster travel along a track section where such control is used to compensate for characteristics of the track that may otherwise require a reduction in speed.

The characteristic of the track may be actively sensed (e.g., sensed while the railway vehicle is traveling along the track and used to provide a motive force, transport passengers, transport freight, or used for still another primary purpose, etc.) or data relating to the characteristic may be retrieved from a database. In other embodiments, the active suspension system both actively senses the characteristic of the track and retrieves data relating to the characteristic of the track from a database. The characteristic is used for controlling the suspension system to compensate for variations associated with one or more characteristics of the track that may otherwise increase (e.g., increase the oscillations of, increase the magnitude of, etc.) loading experienced by the chassis. The characteristic may also be used for controlling the suspension system to compensate for route variations (e.g., curves, etc.) that may otherwise decrease the permitted speed of the train.

Referring to FIG. 1, a train, shown as train 10, includes a plurality of railway vehicles and is configured to travel along a track, shown as track 20. As shown in FIG. 1, train 10 includes a first railway vehicle, shown as locomotive 30, a second railway vehicle, shown as freight car 40, a third railway vehicle, shown as passenger rail car 50, and a fourth railway vehicle, shown as test vehicle 60. In other embodiments, train 10 does not include at least one of locomotive 30, freight car 40, passenger rail car 50, and test vehicle 60. In still other embodiments, train 10 may include another combination of railway vehicles configured to travel along a track. In yet other embodiments, the first railway vehicle and the second railway vehicle are portions of a common rail vehicle (e.g., a front and a rear chassis of the same rail vehicle, etc.). Locomotive 30, freight car 40, passenger rail car 50, and test vehicle 60 may have various shapes and may include various components intended to facilitate operation or use thereof. By way of example, freight car 40 may include a tank configured to contain a liquid therein, may include a box (e.g., a shipping container, etc.) configured to contain cargo therein, or may include stakes configured to at least partially secure freight (e.g., to transport logs, etc.), among other alternatives. By way of another example, passenger rail car 50 may include various seats for use by a plurality of passengers.

As shown in FIG. 1, locomotive 30 includes a chassis 32 and a suspension system 34. In one embodiment, suspension system 34 is configured to at least partially isolate chassis 32 from variations associated with one or more characteristics of track 20. Freight car 40 includes a chassis 42 and a suspension system 44, according to the embodiment shown in FIG. 1. Suspension system 44 is configured to at least partially isolate chassis 42 from variations associated with one or more characteristics of track 20, according to one embodiment. As shown in FIG. 1, passenger rail car 50 includes a chassis 52 and a suspension system 54. Suspension system 54 may be configured to at least partially isolate chassis 52 from variations associated with one or more characteristics of track 20. Test vehicle 60 includes a chassis 62 and a suspension system 64, according to the embodiment shown in FIG. 1. In one embodiment, suspension system 64 is configured to at least partially isolate chassis 62 from variations associated with one or more characteristics of track 20. In other embodiments, at least one of locomotive 30, freight car 40, passenger rail car 50, and test vehicle 60 does not include a suspension system or includes a different arrangement of components configured to at least partially isolate the chassis thereof from variations associated with one or more characteristics of track 20.

According to the embodiment shown in FIG. 1, locomotive 30, freight car 40, passenger rail car 50, and test vehicle 60 include wheels 36, wheels 46, wheels 56, and wheels 66, respectively. As shown in FIG. 1, wheels 36, wheels 46, wheels 56, and wheels 66 engage track 20 and may be provided as part of hub assemblies of locomotive 30, freight car 40, passenger rail car 50, and test vehicle 60. By way of example, wheels 36, wheels 46, wheels 56, and wheels 66 may be in rolling engagement with rails of track 20. Suspension system 34, suspension system 44, suspension system 54, and suspension system 64 may provide isolation from variations associated with one or more characteristics of track 20 that are communicated by wheels 36, wheels 46, wheels 56, and wheels 66. In other embodiments, at least one of locomotive 30, freight car 40, passenger rail car 50, and test vehicle 60 do not include wheels configured to engage track 20. By way of example, hub assemblies of at least one of locomotive 30, freight car 40, passenger rail car 50, and test vehicle 60 may include one or more magnets (e.g., permanent magnets, electromagnets, etc.) configured to interface with a track (i.e., train 10 may be operate using magnetic levitation). In such embodiments, at least one of suspension system 34, suspension system 44, suspension system 54, and suspension system 64 may isolate the chassis from variations associated with one or more characteristics of the track (e.g., variations associated with one or more characteristics of a maglev track, etc.).

Figure 2:
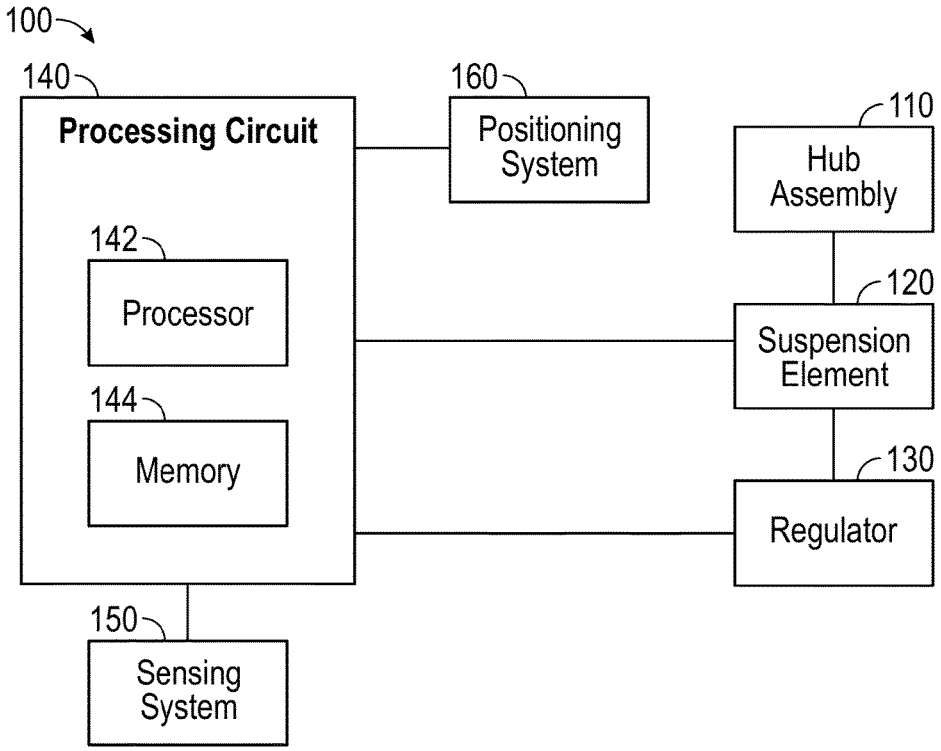
FIG. 2 is a schematic view of a suspension system for a railway vehicle, according to one embodiment.
Figure 3:
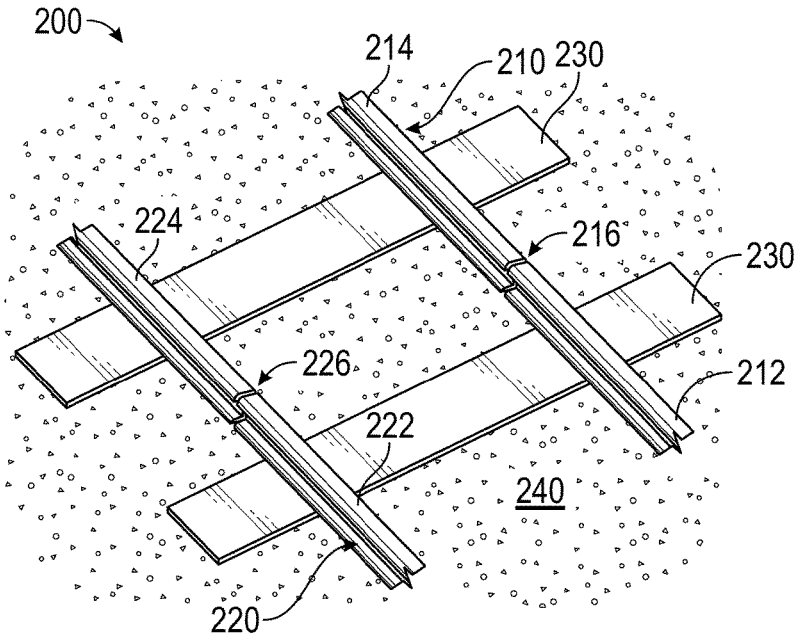
FIG. 3 is a perspective view of a track upon which a railway vehicle travels, according to one embodiment.

Referring next to the embodiment shown in FIG. 2, a suspension system, shown as suspension system 100, is configured to be implemented as part of a railway vehicle. By way of example, at least one of suspension system 34, suspension system 44, suspension system 54, and suspension system 64 may include suspension system 100. Suspension system 100 is configured to at least partially isolate a chassis of the railway vehicle from variations associated with one or more characteristics of the track. In one embodiment, suspension system 100 is configured to provide suspension forces that vary based on location-specific track conditions.

Each of the railway vehicles of a train may include suspension system 100. In other embodiments, suspension system 100 is included on only a subset of the railway vehicles of a train. By way of example, suspension system 100 may be phased in car-by-car, thereby allowing operators to assemble trains with only improved railway vehicles having suspension system 100 or assemble trains with both improved railway vehicles and railway vehicles having traditional suspension systems. In one embodiment, suspension system 100 is provided as a premium rail transport item implemented on "first class" passenger cars and freight cars intended to transport sensitive cargo first and thereafter implemented on other passenger cars and freight cars intended to transport less-sensitive cargo. Operators may charge more to provide transport via railway vehicles equipped with suspension system 100. Suspension system 100 may be retrofitted to existing railway vehicles or implemented into newly-constructed railway vehicles, according to various embodiments.

As shown in FIG. 2, suspension system 100 includes hub assembly 110 that is coupled to suspension element 120. In one embodiment, hub assembly 110 is configured to travel along a track. Hub assembly 110 may include at least one of a truck, a lateral frame member (e.g., a transverse bolster, etc.), one or more longitudinal frame members (e.g., one or more side frames, etc.), and one or more wheels, among other components. Suspension element 120 is configured to provide a suspension force, according to one embodiment. The suspension force provided by suspension element 120 may oppose forces imparted by variations associated with one or more characteristics of the track, thereby altering (e.g., reducing the oscillations of, reducing the magnitude of, etc.) forces experienced by the chassis of the railway vehicle.

In one embodiment, suspension element 120 is or includes a spring (e.g., a gas spring, etc.). In other embodiments, suspension element 120 is or includes a damper, both a spring and a damper, still another component, or still another combination of components. The suspension force provided by suspension element 120 may include a spring force, a damping force, a combination of a spring force and a damping force, still another type of force, or still another combination of forces. Suspension element 120 is disposed between hub assembly 110 and a chassis of the railway vehicle, according to one embodiment. In other embodiments, suspension element 120 is disposed between and couples various components of hub assembly 110 (e.g., between a transverse bolster or other lateral frame member and a side frame or other longitudinal frame member, etc.).

As shown in FIG. 2, suspension system 100 includes a regulator 130 that is coupled to suspension element 120. In one embodiment, regulator 130 is configured to selectively adjust suspension element 120 so as to adjust the suspension force provided by suspension element 120. Regulator 130 may be configured to selectively adjust suspension element 120 in response to a control signal. By way of example, regulator 130 may be or include an actuator (e.g., a linear actuator, a rotary actuator, etc.) positioned to alter a condition of suspension element 120. In one embodiment, suspension element 120 includes a spring configured to provide a suspension force (e.g., a spring force, etc.) that varies based on a spring constant thereof and the initial state of the spring (e.g., a distance between a compressed state and an equilibrium state, etc.). The actuator may be engaged to change the initial state of the spring (e.g., extended to compress or further compress the spring, etc.), thereby selectively adjusting the suspension force provided by suspension element 120 in response to variations associated with a condition of the track. By way of another example, the actuator may be engaged to change the spring constant of the spring, thereby selectively adjusting the suspension force provided by suspension element 120. By way of another example, the actuator may be engaged to change an attachment location between the spring and a mount on suspension element 120, hub assembly 110, or the chassis, thereby selectively adjusting a spring constant of the spring and hence the suspension force provided by suspension element 120. By way of yet another example, suspension element 120 may include a system of two or more springs (e.g., in parallel, in series, etc.), one or more of which may be selectively attached or detached to vary the overall spring constant of the spring system. In other embodiments, suspension element 120 includes a damper. The damper may be configured to provide a suspension force (e.g., a damping force, etc.) that varies based on a damping constant. In one embodiment, the damping constant of the damper varies based on a preload applied to one or more shims thereof. The actuator may be engaged to change at least one of the damping constant, a damping fluid within the damper, and the initial state of the damper (e.g., extended to apply an increased preload on shims of the damper, etc.), thereby selectively adjusting the suspension force provided by suspension element 120.

In other embodiments, regulator 130 includes a source of pressurized fluid (e.g., a pressurized reservoir, a pump, etc.) that is in fluid communication with suspension element 120 (e.g., an internal volume of suspension element 120). Suspension element 120 may include a gas spring (e.g., an air bag, etc.) configured to provide a suspension force that varies based on the pressure of a gas within an internal chamber thereof (e.g., the pressure of a gas within a compression chamber, etc.). In one embodiment, the source of pressurized fluid is selectively engaged to vary the pressure of the gas within the internal chamber of suspension element 120. In another embodiment, regulator 130 is configured to reduce the pressure of the fluid within the internal chamber of suspension element 120 (e.g., by moving gas from the internal chamber of suspension element 120 into a reservoir, by venting the gas, etc.). In still another embodiment, suspension element 120 includes a hydraulic spring, and regulator 130 is configured to increase or decrease a pressure or an amount of the hydraulic fluid within the hydraulic spring. In yet another embodiment, suspension element 120 includes a magnetic spring, and regulator 130 is configured to increase or decrease a magnetic field, to change a position or orientation of a magnet, or to change a magnetic permeability of the magnetic spring.

In other embodiments, suspension element 120 includes a damper configured to provide a suspension force that varies based on a preload applied to one or more shims thereof. The source of pressurized fluid for regulator 130 may be selectively engaged to vary a preload on the shims (e.g., applying an increased preload may increase the damping forces or provide damping forces that are stiffer, etc.). By way of example, the source of pressurized fluid may be selectively engaged directly by turning on or off the source of pressurized fluid, directly by adjusting an outlet pressure of the source of pressurized fluid, or indirectly by actuating one or more valves disposed along a fluid communication line between regulator 130 and suspension element 120.

Referring again to FIG. 2, suspension system 100 includes processing circuit 140. Processing circuit 140 is coupled to (e.g., in communication with, etc.) suspension element 120, according to the embodiment shown in FIG. 2. In one embodiment, processing circuit 140 is configured to proactively adjust a characteristic of suspension system 100 (e.g., adjust suspension element 120 to vary the suspension force provided by suspension element 120, etc.) based on measured, location specific characteristics of the track (e.g., for an upcoming length of track, based on an upcoming position along the track, etc.). In one embodiment, processing circuit 140 is configured to adjust the characteristic of suspension system 100 by continuously engaging regulator 130. In other embodiments, processing circuit 140 is configured to periodically engage or disengage regulator 130 (e.g., based on a specified time interval, based on a specified distance interval, etc.). In still other embodiments, processing circuit 140 is configured to at least one of determine the target configuration for suspension element 120 and engage or disengage regulator 130 based on a value or other data associated with the characteristic of the track falling below or exceeding a threshold (e.g., a threshold value, a threshold range, etc.), thereby producing a deadband zone within which suspension system 100 is not adjusted.

Processing circuit 140 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components. According to the embodiment shown in FIG. 2, processing circuit 140 includes processor 142 and memory 144. Processor 142 may include an ASIC, one or more FPGAs, a DSP, circuits containing one or more processing components, circuitry for supporting a microprocessor, a group of processing components, or other suitable electronic processing components.

In some embodiments, processor 142 is configured to execute computer code stored in memory 144 to facilitate the activities described herein. Memory 144 may be any volatile or non-volatile computer-readable storage medium capable of storing data or computer code relating to the activities described herein. In one embodiment, memory 144 has computer code modules (e.g., executable code, object code, source code, script code, machine code, etc.) configured for execution by processor 142. In some embodiments, processing circuit 140 represents a collection of processing devices (e.g., servers, data centers, etc.). In such cases, processor 142 represents the collective processors of the devices, and memory 144 represents the collective storage devices of the devices.

Processing circuit 140 may actively control suspension element 120 (e.g., control suspension element 120 as the railway vehicle travels along the track, etc.) to alter the forces experienced by the chassis of the railway vehicle. In one embodiment, processing circuit 140 is configured to determine a target configuration for suspension element 120 using a characteristic of the track at a target position. Processing circuit 140 may engage or disengage regulator 130 based on the target configuration (e.g., generate a control signal for regulator 130 that varies based on the target configuration for suspension element 120, etc.). In one embodiment, suspension element 120 includes a sensor configured to provide sensing signals to processing circuit 140. Processing circuit 140 may use the sensing signals as part of a feedback control scheme to reduce the risk of suspension element 120 providing an inappropriate suspension force.

The target position may be selected based on a location (e.g., a current location, etc.) of the train or railway vehicle. By way of example, the target position may include at least one of an upcoming length of track, an upcoming position along the track, a particular section of track along which the train is traveling, a position an offset distance from the train or railway vehicle, a position of a hub assembly, a position in front of a hub assembly, and an upcoming position at which a characteristic of the track exceeds a threshold, among other alternatives. As the railway vehicle travels along the track, the selected target position may also vary (i.e., the target position may vary with the position of the railway vehicle).

The target configuration for suspension element 120 may include a state (e.g., an initial state of a spring, a pressure of a gas within a compression chamber of a spring, a preload on one or more shims of a damper, etc.) in which suspension element 120 will produce a target suspension force (e.g., a suspension force intended to reduce the effect of the characteristic of the track at the target position on a chassis of the railway vehicle, etc.). In embodiments where processing circuit 140 determines the target configuration using a target position that varies based on a location of the railway vehicle, the suspension force applied by suspension element 120 may vary based on the location of the railway vehicle.

According to the embodiment shown in FIG. 2, suspension system 100 includes sensing system 150. Sensing system 150 is configured to evaluate the characteristic of the track at the target position, according to one embodiment. Sensing system 150 may provide sensing signals to processing circuit 140. Processing circuit 140 may evaluate the sensing signals to determine a value or other data relating to the characteristic of the track at the target position. In one embodiment, sensing system 150 includes a scanner positioned to evaluate the characteristic of the track at the target position.

A track database may be stored within memory 144. The track database may include values or other data relating to the characteristics of the track for a plurality of locations. By way of example, the track database may include values or other data relating to a characteristic of the track for each junction, or for points spaced an offset distance along a length of the track, among other alternatives. The track database may be stored within an onboard memory or may be stored in an external memory. The track database may be received by the vehicle (e.g., via wireless reception, etc.) as needed. Information from an externally-stored database may be received at least one of based on a schedule, based on the location of the vehicle (e.g., data associated with track locations near the current location of the vehicle, etc.), and in response to a query, among other prompts. Processing circuit 140 may be configured to retrieve the values or other data that are associated with the characteristic of the track at the target position from memory 144.

The track database may also include one or more features of a route the track follows. In one embodiment, processing circuit 140 is configured to determine the target configuration for suspension element 120 using a feature of the route the track follows. By way of example, the track database may include information relating to a radius of curvature or a bank angle for the route at various locations, and processing circuit 140 may determine the target configuration for suspension element 120 using the radius of curvature or the bank angle.

In one embodiment, suspension system 100 does not include sensing system 150, and processing circuit 140 retrieve values or other data that are associated with the characteristic of the track at the target position from the track database. Processing circuit 140 may utilize such retrieved values or other data to determine the target configuration for suspension element 120. In other embodiments, a track database is not stored within memory 144, and processing circuit 140 uses sensing signals from sensing system 150 to determine a value or other data relating to the characteristic of the track at the target position and the target configuration for suspension element 120. In still other embodiments, a track database is stored within memory 144 and suspension system 100 includes sensing system 150. Processing circuit 140 may compare retrieved values or other data relating to a characteristic of the track at a target position to values or other data determined based on sensing signals from sensing system 150. In one embodiment, processing circuit 140 determines the target configuration for suspension element 120 based on both the retrieved values or other data and the values or other data determined based on sensing signals from sensing system 150. Processing circuit 140 may at least one of write and update values or other information relating to the characteristic of the track for a target position to the track database stored within memory 144 (e.g., where the track database does not have values or other data for a particular characteristic of the track at a particular position, where the value or other data determined using the sensing signals from sensing system 150 is different than the value or other data stored within the track database, etc.). Track database updates may be delivered (e.g., wirelessly, by data cables or fibers, by physical media, etc.) to an externally-stored track database.

As shown in FIG. 2, suspension system 100 includes positioning system 160. By way of example, positioning system 160 may include a global positioning system, a speed sensor, or still another device. Positioning system 160 provides processing circuit 140 with at least one of the current position and the speed of the railway vehicle, according to one embodiment. Processing circuit 140 may use the current position, speed, or other information provided by positioning system 160 when retrieving information from the track database (e.g., to retrieve values or other data relating to a characteristic of the track at a location of interest, etc.). In other embodiments, processing circuit 140 is configured to use the speed of the railway vehicle when determining the target configuration for the suspension element (e.g., to soften the suspension when the railway vehicle is traveling faster, etc.).

Referring next to FIGS. 3-7, the processing circuit may use one of various characteristics of a track, shown as track 200, along which the railway vehicle travels to determine the target configuration for a suspension element. According to one embodiment, the characteristic of track 200 includes a value or data associated with a route of track 200. By way of example, the value or data associated with a route of track 200 may include a radius of curvature or a bank angle for track 200 at the target position. The processing circuit may be configured to determine a target configuration for the suspension element using the radius of curvature or the bank angle (e.g., to reduce the risk of derailment, etc.) and engage a regulator to adjust the suspension force applied by a suspension element. Such adjustment may facilitate faster travel of the train through the curved section of track 200.

The processing circuit may evaluate a value or other data associated with the characteristic of track 200 at the target position to determine the target configuration for the suspension element. In one embodiment, the characteristic relates to a feature of track 200 itself (e.g., an original quality of the roadbed, how securely mounted a given section is, etc.). As shown in FIGS. 3-7, track 200 includes first rail 210 and second rail 220. First rail 210 includes first rail section 212 and second rail section 214. Junction 216 is formed between ends of first rail section 212 and second rail section 214. Second rail 220 includes first rail section 222 and second rail section 224. Junction 226 is formed between ends of first rail section 222 and second rail section 224. As shown in FIGS. 3-7, first rail 210 and second rail 220 are laid upon a plurality of ties 230 and extend along ballast layer 240.

Figure 4:
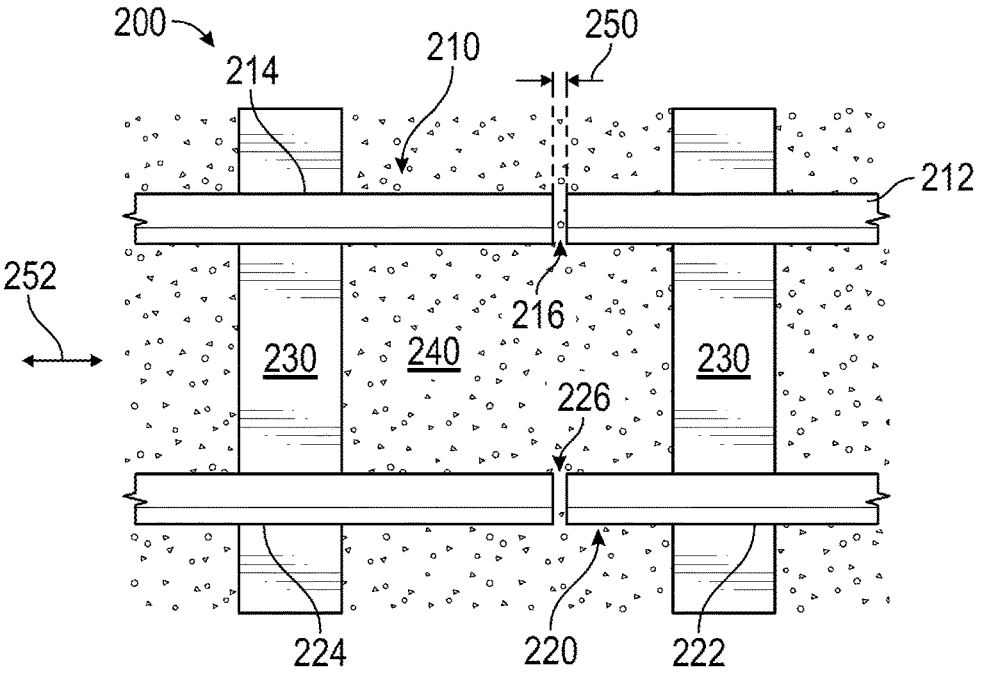
FIGS. 4-7 are top and side views of tracks upon which a railway vehicle travels, according to various embodiments.

In one embodiment, the characteristic of the track used by the processing circuit to determine the target configuration for the suspension element includes a discontinuity at junction 216 and junction 226. As shown in FIG. 4, the discontinuity may include spacing 250 between ends of first rail section 212 and second rail section 214. Spacing 250 may vary between zero and five millimeters. Under certain conditions, spacing 250 may exceed five millimeters. In one embodiment, spacing 250 is measured along a longitudinal direction 252 (e.g., the direction the railway vehicle travels along when engaging first rail 210 and second rail 220, etc.). Spacing 250 may occur at least in part due to temperature changes that cause first rail section 212 and second rail section 214 to contract, thereby opening junction 216. Cold temperatures may produce pull apart, and sun kink or another form of buckling may be produced by higher temperatures. Such conditions may occur at least when an anchor used to secure at least one of first rail 210 and second rail 220 fails. Such sun kink or pull apart may produce a discontinuity at junction 216 and junction 226 or another variation along the length of track 200.

Figure 5:
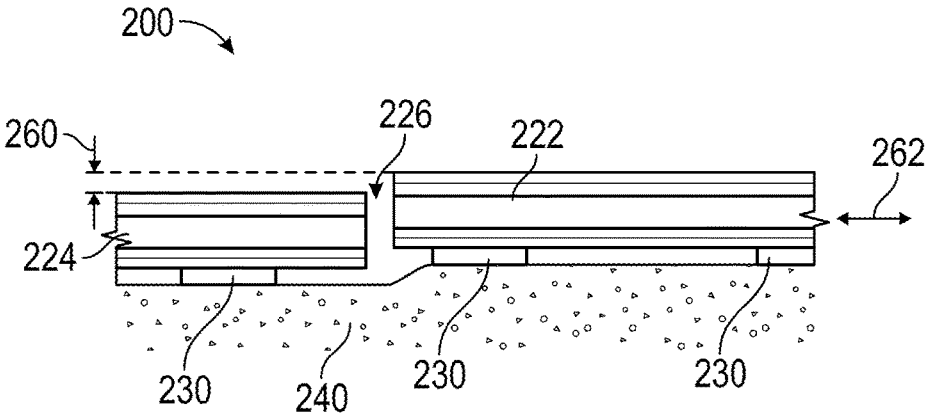

Referring next to FIG. 5, the discontinuity may include spacing 260 between ends of first rail section 222 and second rail section 224. In one embodiment, spacing 260 is measured along a vertical direction 262. Spacing 260 may occur at least in part due to variations in ballast layer 240 (e.g., due to thawing or freezing thereof, due to settling, etc.) that cause relative vertical movement first rail section 222 and second rail section 224. The position or condition of ties 230 may also produce spacing 260 as, by way of example, a broken anchor or tie 230 may cause second rail section 224 to sink relative to first rail section 222.

Figure 6:
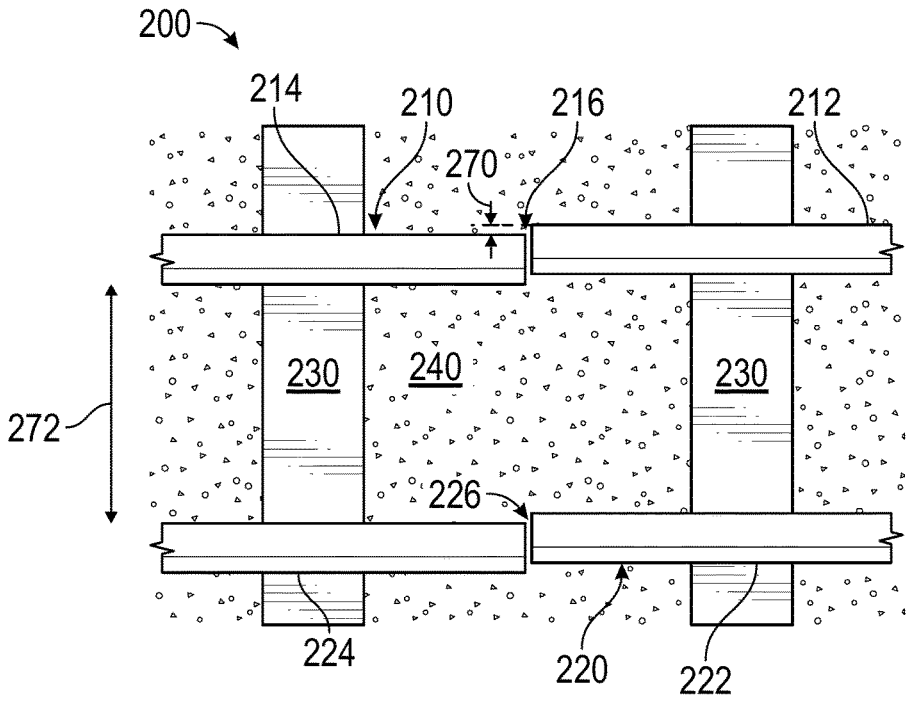

As shown in FIG. 6, the discontinuity may include spacing 270 between ends of first rail section 212 and second rail section 214. In one embodiment, spacing 270 is measured along a lateral direction 272 (e.g., a direction parallel to ties 230, a direction perpendicular to the vertical direction and the direction the railway vehicle travels along when engaging first rail 210 and second rail 220, etc.). Spacing 270 may occur at least in part due to variations in ballast layer 240 that cause relative movement of first rail section 212 and second rail section 214.

Figure 7:
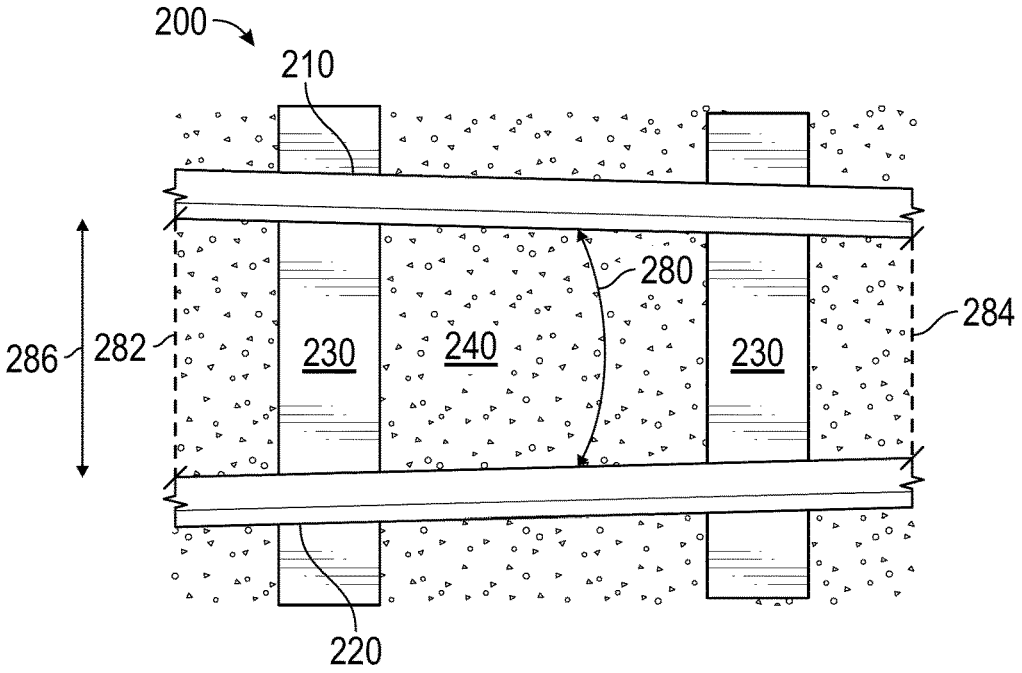

Referring next to FIG. 7, first rail 210 may be offset relative to second rail 220. As shown in FIG. 7, first rail 210 is angularly offset and disposed at angle 280 relative to second rail 220. The offset condition of first rail 210 and second rail 220 may produce first lateral spacing 282 (e.g., a first gauge, etc.) at a first position along track 200 and second lateral spacing 284 (e.g., a second gauge, etc.) at a second position along track 200. As shown in FIG. 7, first lateral spacing 282 and second lateral spacing 284 are measured across a length of track 200 along direction 286 (e.g., a direction parallel to ties 230, a direction perpendicular to the vertical direction and the direction the railway vehicle travels along when engaging first rail 210 and second rail 220, etc.). The variation in gauge may occur at least in part due to differential thermal expansion of first rail 210 and second rail 220, due to an anchor or tie 230 that is broken, or due to variations in ballast layer 240, among other reasons. A rail height variation may also occur between first rail 210 and second rail 220 (i.e., first rail 210 may have a different vertical position than second rail 220 at a target position along track 200).

Figure 8:
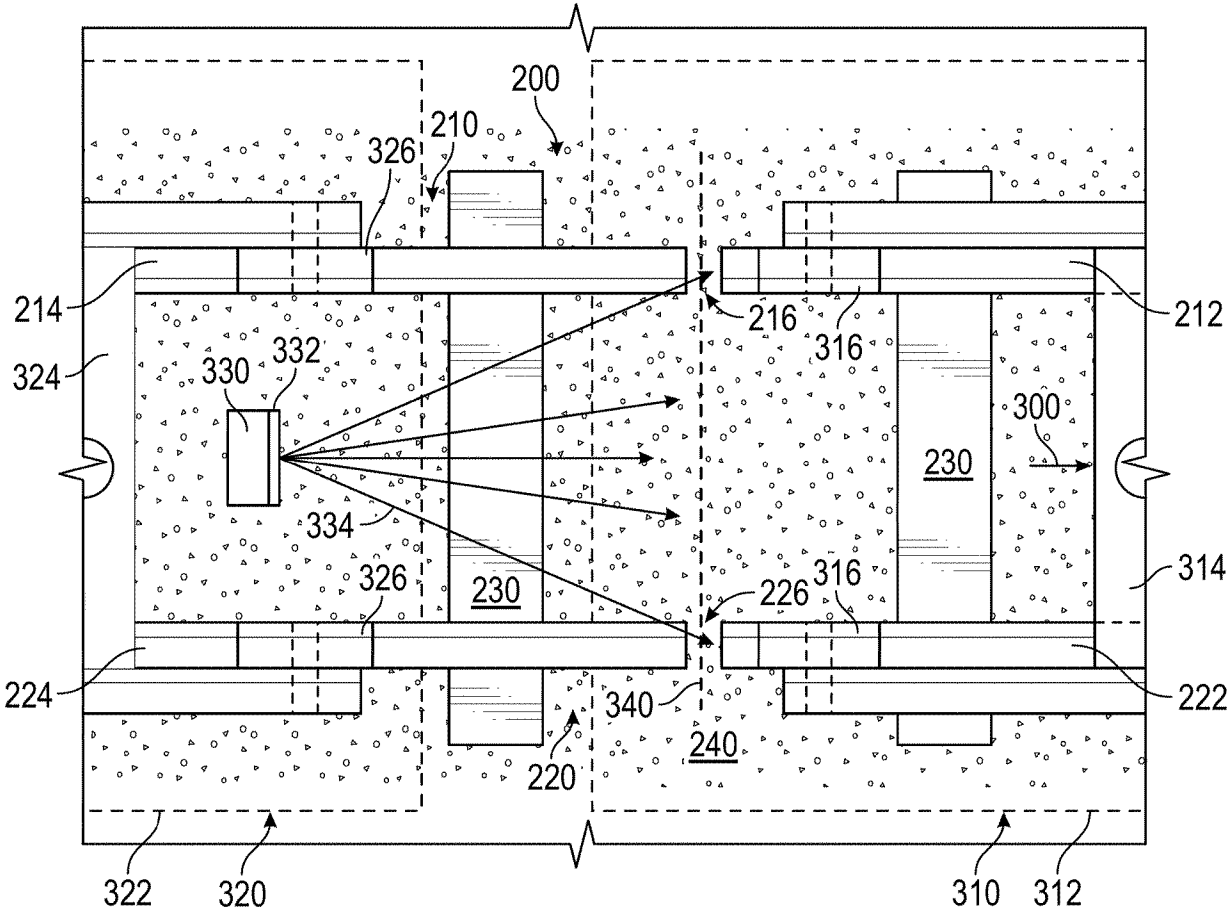
FIG. 8 is a top view of a railway vehicle including an evaluation system, according to one embodiment.
Figure 9:
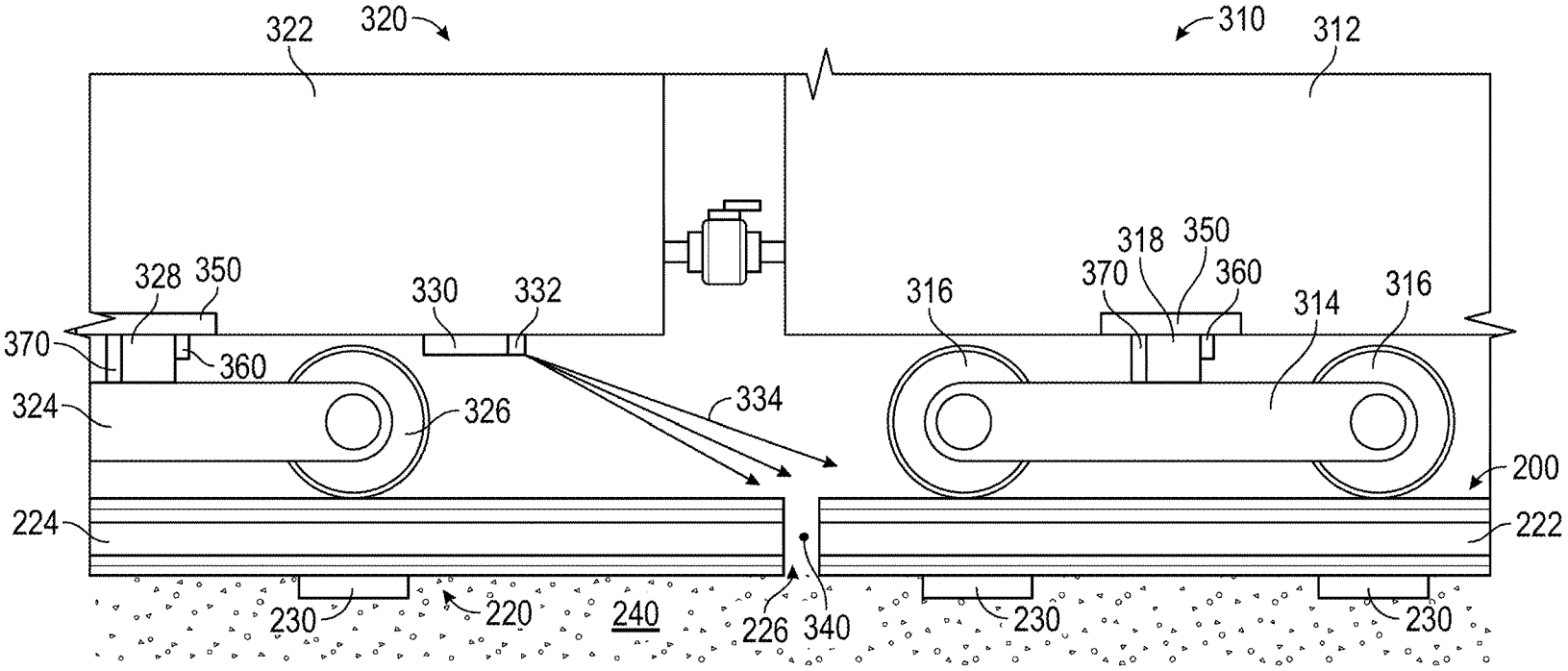
FIG. 9 is a side view of a railway vehicle including an evaluation system, according to one embodiment.

According to the embodiment shown in FIGS. 8-9, first railway vehicle 310 and a second railway vehicle 320 are configured to engage track 200 and travel along direction 300. As shown in FIGS. 8-9, first railway vehicle 310 is in front of second railway vehicle 320. First railway vehicle 310 includes chassis 312 and a truck, shown as truck 314. Truck 314 couples chassis 312 to a plurality of hub assemblies that include wheels 316. Wheels 316 engage first rail 210 and second rail 220, according to one embodiment. As shown in FIG. 9, first railway vehicle 310 includes a suspension element 318 that is configured to provide a suspension force. Second railway vehicle 320 includes a chassis 322 and a truck, shown as truck 324. Truck 324 couples chassis 322 to a plurality of hub assemblies that include wheels 326. Wheels 326 engage first rail 210 and second rail 220, according to one embodiment. As shown in FIG. 9, second railway vehicle 320 includes a suspension element 328 that is configured to provide a suspension force.

As shown in FIGS. 8-9, an evaluation system 330 (e.g., a sensing system, an inspection system, etc.) is positioned to evaluate a characteristic of track 200. In one embodiment, evaluation system 330 includes a sensing system. The sensing system includes a sensor 332 that is coupled to second railway vehicle 320. According to another embodiment, sensor 332 is coupled to first railway vehicle 310. In one embodiment, sensor 332 includes a scanner (e.g., laser, ultrasound, microwave, etc.). In another embodiment, sensor 332 includes a camera (e.g., video camera, still camera, stereoscopic camera, spectrally illuminated camera, etc.). In still another embodiment, sensor 332 includes a magnet configured to monitor a position of the rails based on their magnetic response. Sensor 332 may evaluate a characteristic of track 200, and a processing circuit 350 may be used to determine a target configuration of suspension element 328 or other suspension elements of other railway vehicles behind first railway vehicle 310. Regulators associated with second railway vehicle 320 or other railway vehicles behind first railway vehicle 310 may be engaged (e.g., using a common processing circuit 350, using separate processing circuits 350, etc.) based on the target configuration such the suspension forces applied by the suspension elements are controlled based on the value or other data associated the characteristic of track 200 evaluated by sensor 332.

In other embodiments, processing circuit 350 of first railway vehicle 310 is coupled to evaluation system 330 and configured to communicate the value or other data associated with the characteristic of track 200 with second railway vehicle 320 or other railway vehicles of the train. By way of example, processing circuit 350 of first railway vehicle 310 may communicate the value or other data associated with the characteristic of track 200 with processing circuits 350 of second railway vehicle 320 or other railway vehicles of the train. Such processing circuits 350 of second railway vehicle 320 or other railway vehicles of the train may thereafter determine a target configuration for the suspension elements of the railway vehicles (e.g., suspension element 328 of second railway vehicle 320, etc.) and engage regulators to vary the suspension forces provided thereby. The characteristic of track 200 may also be used by processing circuit 350 of a railway vehicle to determine a target configuration for a suspension element associated with a more-rearward axle assembly (e.g., relative to the target position evaluated by sensor 332, etc.) of the same railway vehicle (e.g., first railway vehicle 310 in embodiments where sensor 332 is coupled to first railway vehicle 310, etc.)

As shown in FIGS. 8-9, sensor 332 directs a plurality of sensing signals, shown as scanning beams 334, toward track 200. The characteristic of track 200 evaluated by evaluation system 330 may include the measure or presence of a discontinuity at junction 216 and junction 226 (e.g., spacing 250, spacing 260, spacing 270, etc.). In other embodiments, the characteristic of track 200 evaluated by evaluation system 330 includes at least one of a gauge variation between the first rail 210 and second rail 220, a rail height variation between the first rail 210 and second rail 220, a deformation due to sun kink, and a deformation due to pull apart. In still other embodiments, the characteristic of track 200 evaluated by evaluation system 330 includes the presence of an anchor or tie 230 that is at least one of broken and damaged. The characteristic of track 200 may also include a level of support provided by ballast layer 240. In other embodiments, the characteristic of track 200 includes the original quality of ballast layer 240 or another measure of original roadbed quality. In still other embodiments, the characteristic of track 200 includes a track compliance.

The characteristic of track 200 may be independent of or dependent on railway vehicle load (e.g., loading due to a weight of the railway vehicle, dynamic loading due to one or more accelerations of the railway vehicle, centrifugal effects if the railway vehicle is on a curve, etc.). In one embodiment, the characteristic of track 200 is independent of a weight of first railway vehicle 310. In other embodiments, a value or other data associated with the characteristic of track 200 varies based on a weight of first railway vehicle 310. A processing circuit may be configured to utilize the weight of first railway vehicle 310 and a value or other data associated with the characteristic of track 200 to determine a target configuration for suspension element 328 of second railway vehicle 320.

In one embodiment, evaluation system 330 is positioned to evaluate the characteristic of track 200 at a target position 340. In one embodiment, target position 340 is a position along the length of track 200. As shown in FIG. 8, target position 340 defines a line along which evaluation system 330 evaluates the characteristic of track 200. In other embodiments, target position 340 is a point, region, or zone of track 200. Target position 340 may be defined at junction 216 and junction 226 of track 200 or may be defined at another portion of first rail 210 and second rail 220. In one embodiment, target position 340 is disposed between a hub assembly of first railway vehicle 310 and a hub assembly of second railway vehicle 320.

Target position 340 may be defined at different locations as first railway vehicle 310 and second railway vehicle 320 travel along track 200. In one embodiment, target position 340 is maintained at a fixed offset distance in front of sensor 332, target position 340 thereby moving with second railway vehicle 320. In another embodiment, evaluation system 330 is configured to momentarily hold target position 340 upon a location of interest (e.g., at least one of junction 216 and junction 226, a point where the rail gauge exceeds a threshold, a point where a rail height variation exceed a threshold value, a location of a tie 230, etc.) as second railway vehicle 320 moves along track 200. By way of example, evaluation system 330 may detect the presence of junction 216 or junction 226 and thereafter hold target position 340 to facilitate further examination of a characteristic of track 200 (e.g., to facilitate determining or more accurately determining a value or other data associated with spacing 250, spacing 260, spacing 270, etc.).

Evaluation system 330 may operate according to a first mode of operation whereby track 200 is scanned generally and a second mode of operation whereby a location of interest of track 200 is evaluated in greater detail. Evaluation system 330 may be configured to operate in the first mode of operation until a location of interest is detected (e.g., at least one of junction 216 and junction 226, a point where the rail gauge exceeds a threshold, a point where a rail height variation exceed a threshold value, a location of a tie 230, etc.), at which point evaluation system 330 may be configured to switch into the second mode of operation. Evaluation system 330 may be configured to operate in the second mode until a value or other data associated with the location of interest is determined. Thereafter, evaluation system 330 may be configured to switch back into the first mode of operation.

Referring again to FIG. 9, processing circuit 350 may determine the target configuration for a suspension element (e.g., suspension element 318 of first railway vehicle 310, suspension element 328 of second railway vehicle 320, etc.) based on an oscillatory state (e.g., a current oscillatory state at a present time, etc.) of first railway vehicle 310 or second railway vehicle 320. The oscillatory state may be that of a hub assembly, a suspension element, or a chassis of first railway vehicle 310 or second railway vehicle 320. The oscillatory state may include an oscillation frequency, an oscillation amplitude, an oscillation phase, a direction of oscillation, and/or other oscillatory characteristics. In one embodiment, the target configuration of a suspension element corresponds with increasing or decreasing a spring constant of the suspension so as to offset an oscillation frequency of the suspension system from that of a current oscillatory state of the railway vehicle. In another embodiment, the target configuration of a suspension element corresponds with increasing or decreasing a damping coefficient of the suspension (e.g., if the amplitude of a vehicular oscillatory state is above or below a threshold level or range, etc.). As shown in FIG. 9, first railway vehicle 310 and second railway vehicle 320 include a sensor 360 configured to provide sensing signals relating to the state of first railway vehicle 310 and second railway vehicle 320. Sensor 360 may include a position sensor, a velocity sensor, accelerometer, or still another device.

According to one embodiment, the movement of chassis 312 and chassis 322 is controlled based on the value or other data associated with the characteristic of track 200. As shown in FIG. 9, first railway vehicle 310 and second railway vehicle 320 each include actuator 370. Actuators 370 may directly or indirectly affect the movement of chassis 312 and chassis 322. By way of example, actuators 370 may be configured to apply a force to chassis 312 and chassis 322 (e.g., to directly affect the movement of chassis 312, etc.), may be configured to engage or disengage suspension element 318 and suspension element 328 (e.g., to indirectly affect the movement of chassis 312, etc.), or may still otherwise affect the movement of chassis 312 and chassis 322. Actuator 370 associated with second railway vehicle 320 is configured to selectively engage or disengage at least one of chassis 322 and suspension element 328, according to one embodiment. By way of example, suspension element 328 may be a spring having a first end and a second end, and actuator 370 may be positioned to selectively engage or disengage an end of the spring. In one embodiment, processing circuit 350 is configured to determine a target actuation profile for chassis 322 using a characteristic of track 200 at target position 340. Target position 340 varies based on a location of second railway vehicle 320, according to one embodiment. Processing circuit 350 may also engage actuator 370 based on the target actuation profile such that the movement of chassis 322 is controlled based on the location of second railway vehicle 320.

In one embodiment, the target actuation profile includes a function relating at least one of a position (e.g., a vertical position), a speed and/or direction of motion, an acceleration, and a jerk associated with chassis 322 to an independent variable (e.g., location, position along track 200, time, etc.). By way of example, the characteristic of track 200 at target position 340 may include a vertical rail height variation (e.g., a step down, etc.) at junction 226 of second rail 220. Processing circuit 350 may use a value or other data relating to the vertical rail height variation (e.g., a measure of the difference between ends of first rail section 222 and second rail section 224, etc.) to determine the target actuation profile for chassis 322. The target actuation profile for chassis 322 may include at least one of a position change, an acceleration, and a jerk and may be intended to reduce the effect of the vertical rail height variation on chassis 322. By way of example, the target actuation profile may include an upward acceleration of chassis 322 as wheel 326 encounters the rail height variation. Processing circuit 350 may engage actuator 370 to apply the upward acceleration directly to chassis 322 (e.g., to produce movement of chassis 322 that is at least partially in conformance with the target actuation profile, etc.). By way of another example, the target actuation profile may include a desired movement of chassis 322 as wheel 326 encounters the rail height variation. Processing circuit 350 may engage actuator 370 to selectively engage suspension element 328 and reduce the effect of the vertical height variation on chassis 322. By way of example, actuator 370 may be positioned to decrease the pressure within a gas spring, thereby softening the suspension system of second railway vehicle 320 (e.g., to produce movement of chassis 322 that is at least partially in conformance with the target actuation profile, etc.). In general, the time response of suspension elements is limited; processing circuit 350 may be configured to begin the adjustment of suspension element 328 or the engagement/disengagement of actuator 370 before the hub assembly arrives at a target position, and/or to end such actions after the hub assembly leaves the target position.

Processing circuit 350 may determine the target actuation profile for chassis 322 based on a threshold value associated with the movement of chassis 322. By way of example, the threshold value may include at least one of an oscillation direction, an oscillation amplitude (e.g., a maximum oscillation amplitude, etc.), an oscillation frequency (e.g., a maximum oscillation frequency, etc.), and a rate (e.g., acceleration, jerk, etc.) associated with the movement of chassis 322. By way of example, the target actuation profile may include an acceleration intended to reduce the oscillation amplitude of chassis 322. The acceleration may be applied by actuator 370 as a force to chassis 322 or may be produced due to the selective engagement or disengagement of suspension element 328 by actuator 370.

In one embodiment, evaluation system 330 includes an inspection system, and sensor 332 is positioned to measure a compliance of track 200 at target position 340. Processing circuit 350 of second railway vehicle 320 may associate the compliance of track 200 with target position 340 and record the compliance of track 200 (e.g., in a memory, etc.) on a location-dependent basis (e.g., as a track database, etc.). Other railway vehicles may later retrieve information about the compliance of track 200 at target position 340. Such vehicles may utilize the information to control suspension systems thereof or to directly actuate movement of their respective chassis.

Sensor 332 is positioned to measure the compliance of track 200 at target position 340 relative to an inertial reference frame, according to one embodiment. The inertial reference frame may be disposed on the first railway vehicle 310, second railway vehicle 320, or in still another location. In one embodiment, a test car is coupled to first railway vehicle 310 and second railway vehicle 320, and the inertial reference frame is disposed on the test car.

The compliance of track 200 may include a deflection of second rail 220 associated with a train-imposed load (e.g., a load imparted on second rail 220 due to the weight of first railway vehicle 310, etc.). The compliance of track 200 may include a measurement of vertical deflection, a measurement of lateral deflection, or still another measurement. By way of example, the compliance of track 200 may include a deflection (e.g., vertical deflection, lateral deflection, etc.) of first rail section 222 associated with the train-imposed load. In other embodiments, the compliance of track 200 includes a relative movement between first rail section 222 and second rail section 224 at junction 226.

In one embodiment, the inspection system is configured to measure static compliance values (e.g., compliance values that vary based on only on an applied load and remain constant as a train passes over a target position, etc.). In other embodiments, the inspection system is configured to measure a dynamic compliance value. By way of example, the dynamic compliance value may vary based on a speed of the train. Processing circuit 350 may be configured to record the compliance of track 200 as a function of location and the speed of the train. In other embodiments, processing circuit 350 is configured to record the compliance of track 200 as a function of location and a weather condition. By way of example, the weather condition may include a temperature value (e.g., a current temperature, a historical temperature, an array of recent temperature values, etc.), a rainfall value (e.g., a current precipitation value, a historical precipitation value, a total precipitation, a total precipitation over a predetermined period of time, etc.), or a value associated with a solar evaporation of moisture from ballast layer 240 or another roadbed of track 200, among other features of the current of previous weather.

Figure 10:
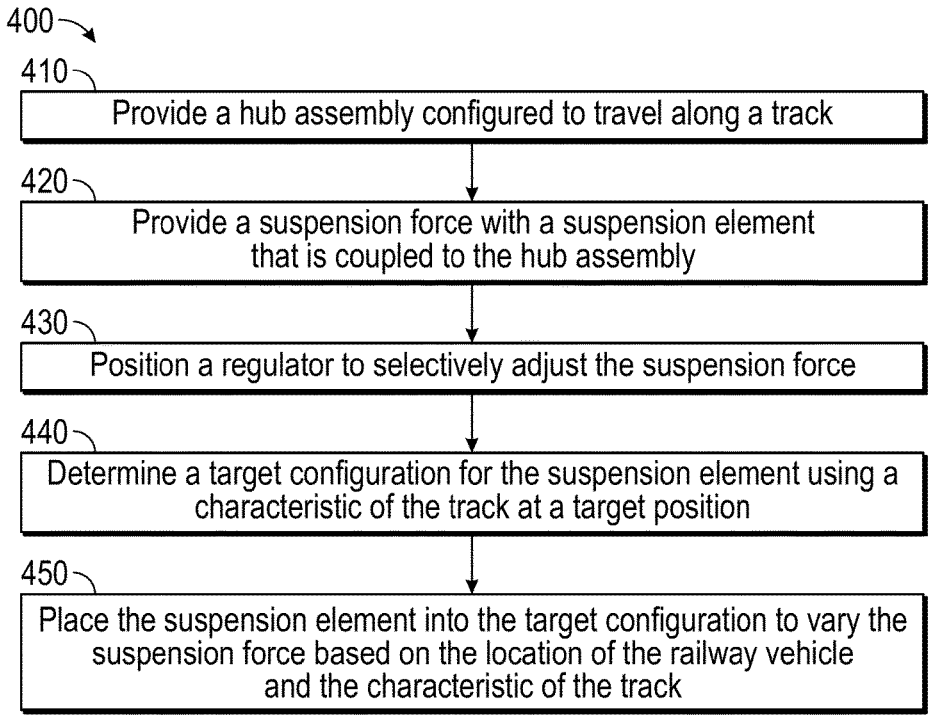
FIG. 10 is flow diagram of a method for controlling a suspension of a railway vehicle, according to one embodiment.

Referring next to the embodiment shown in FIG. 10, a suspension system of a railway vehicle is controlled according to a method 400. As shown in FIG. 10, method 400 includes providing a hub assembly configured to travel along a track (410), providing a suspension force with a suspension element coupled to the hub assembly (420), positioning a regulator to selectively adjust the suspension force (430), and determining a target configuration for the suspension element using a characteristic of the track at a target position (440). The target position may vary based on a location of the railway vehicle. As shown in FIG. 10, method 400 also includes placing the suspension element into the target configuration to vary the suspension force based on the location of the railway vehicle and the characteristic of the track (450). Varying the suspension force applied by the suspension element may include engaging the regulator based on the target configuration.

Figure 11:
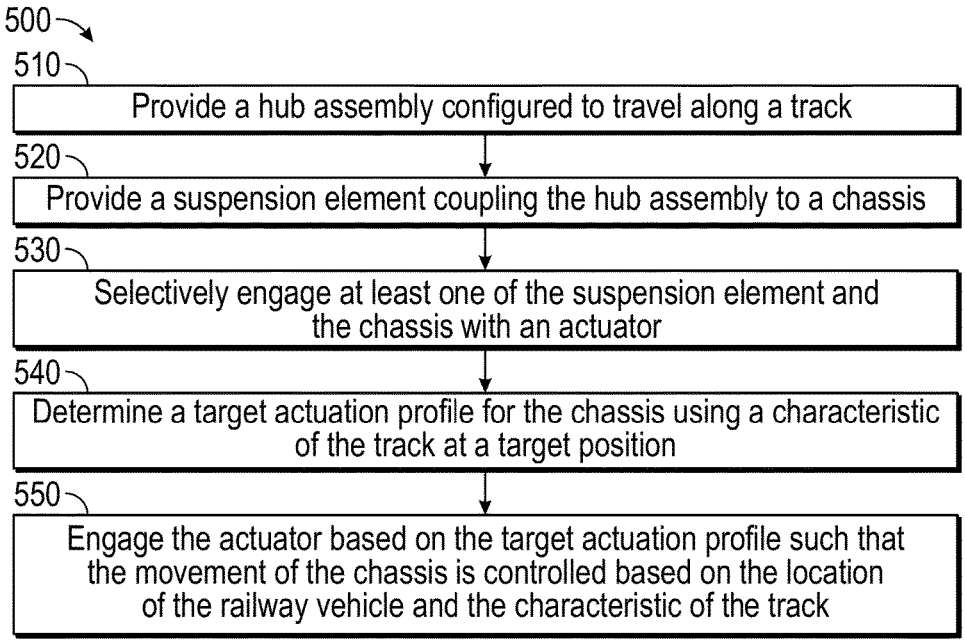
FIG. 11 is flow diagram of a method of operating a railway vehicle, according to one embodiment.

As shown in FIG. 11, a railway vehicle is operated according to a method 500. According to the embodiment shown in FIG. 11, method 500 includes providing a hub assembly configured to travel along a track (510), providing a suspension element coupling the hub assembly to a chassis (520), selectively engaging at least one of the chassis and the suspension element with an actuator (530), and determining a target actuation profile for the chassis using a characteristic of the track at a target position (540). The target position may vary based on a location of the railway vehicle. As shown in FIG. 11, method 500 also includes engaging the actuator based on the target actuation profile such that the movement of the chassis is controlled based on the location of the railway vehicle and the characteristic of the track (550).

Figure 12:
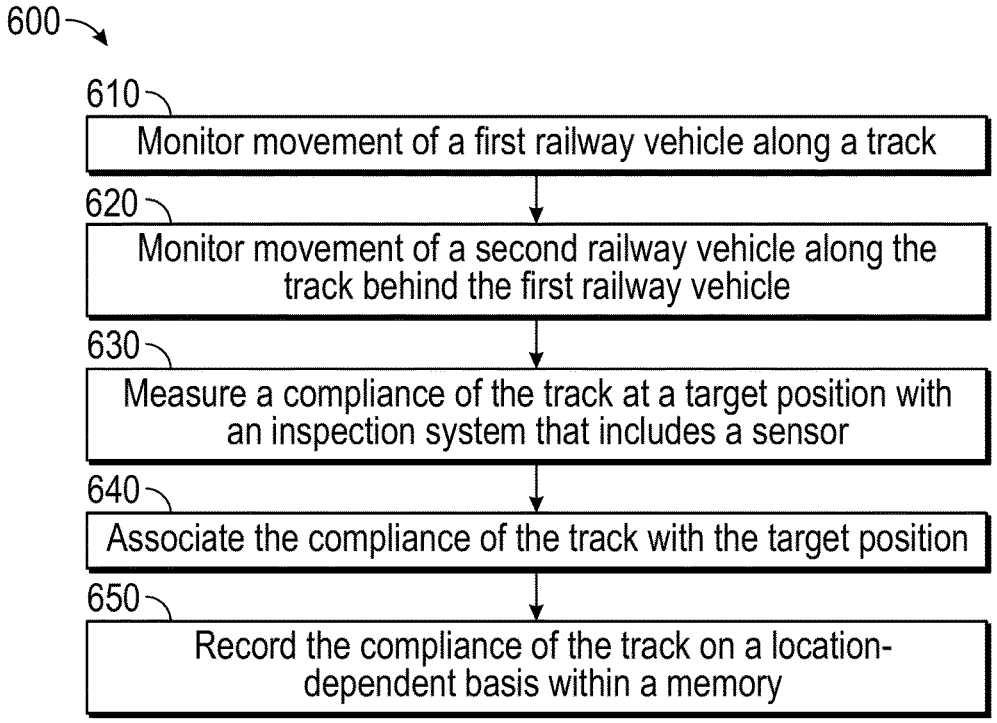
FIG. 12 is flow diagram of a method of monitoring a track, according to one embodiment.

Referring next to the embodiment shown in FIG. 12, a track is monitored according to method 600. As shown in FIG. 12, method 600 includes monitoring movement of a first railway vehicle along the track (610), monitoring movement of a second railway vehicle along the track behind the first railway vehicle (620), measuring a compliance of the track at a target position with an inspection system that includes a sensor (630), associating the compliance of the track with the target position (640), and recording the compliance of the track on a location-dependent basis within a memory (650).

While various aspects and embodiments have been disclosed herein, other aspects and embodiments will be apparent to those skilled in the art. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. Accordingly, all such modifications are intended to be included within the scope of the present inventions. The order or sequence of any process or method steps may be varied or re-sequenced according to other embodiments. The various aspects and embodiments disclosed herein are for purposes of illustration and are not intended to be limiting, with the true scope and spirit being indicated by the following claims.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data, which cause a general-purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

What is claimed is:

1. A suspension system for a railway vehicle, comprising:
- a hub assembly configured to travel along a track;
- a suspension element coupled to the hub assembly and configured to provide a suspension force;
- a regulator coupled to the suspension element and configured to selectively adjust the suspension element; and
- a processing circuit configured to:
  - determine a target configuration for the suspension element using a characteristic of the track at a target position, wherein the target position is selected based on a particular upcoming position of the railway vehicle; and
  - engage the regulator based on the target configuration such that the suspension force applied by the suspension element is based on the particular upcoming position location of the railway vehicle and the characteristic of the track.

2. The system of claim 1, wherein the characteristic of the track includes a discontinuity at a junction between a first rail section and a second rail section.

3. The system of claim 1, wherein the characteristic of the track includes a rail height variation.

4. The system of claim 1, wherein the characteristic of the track includes a presence of a tie that is at least one of broken and damaged.

5. The system of claim 1, wherein the characteristic of the track includes a compliance.

6. The system of claim 1, wherein the characteristic of the track includes a radius of curvature.

7. The system of claim 1, wherein the processing circuit is configured to determine the target configuration for the suspension element using a weight of the railway vehicle.

8. The system of claim 1, wherein the processing circuit is configured to determine the target configuration for the suspension element using a feature of a route the track follows.

9. The system of claim 8, wherein the feature includes a radius of curvature for the route at the target position.

10. The system of claim 1, further comprising a sensing system configured to evaluate the characteristic of the track at the target position.

11. The system of claim 10, wherein the sensing system includes a scanner positioned to evaluate the characteristic of the track at the target position.

12. The system of claim 11, wherein the scanner is positioned to evaluate the characteristic of the track at the target position before arrival of the hub assembly at the target position.

13. A railway vehicle, comprising
- a chassis; and
- a suspension system including:
  - a hub assembly configured to travel along a track;
  - a suspension element coupling the hub assembly to the chassis and configured to provide a suspension force;
  - a regulator coupled to the suspension element and configured to selectively adjust the suspension element; and
  - a processing circuit configured to:
    - determine a target configuration for the suspension element using a characteristic of the track at a target position, wherein the target position is selected based on a particular upcoming position of the railway vehicle; and
    - engage the regulator based on the target configuration such that the suspension force applied by the suspension element is determined based on the particular upcoming position of the railway vehicle and the characteristic of the track.

14. The railway vehicle of claim 13, wherein the characteristic of the track includes a discontinuity at a junction between a first rail section and a second rail section.

15. The railway vehicle of claim 13, wherein the characteristic of the track includes a rail height variation.

16. The railway vehicle of claim 13, wherein the characteristic of the track includes a presence of a tie that is at least one of broken and damaged.

17. The railway vehicle of claim 13, wherein the characteristic of the track includes a compliance.

18. The railway vehicle of claim 13, wherein the characteristic of the track includes a radius of curvature.

19. The railway vehicle of claim 13, wherein the processing circuit is configured to determine the target configuration for the suspension element using a weight of the railway vehicle.

20. The railway vehicle of claim 13, wherein the processing circuit is configured to determine the target configuration for the suspension element using a feature of a route the track follows.

21. The railway vehicle of claim 20, wherein the feature includes a radius of curvature for the route at the target position.

22. The railway vehicle of claim 13, further comprising a sensing system configured to evaluate the characteristic of the track at the target position.

23. The railway vehicle of claim 22, wherein the sensing system includes a scanner positioned to evaluate the characteristic of the track at the target position.

24. The railway vehicle of claim 23, wherein the scanner is positioned to evaluate the characteristic of the track at the target position before arrival of the hub assembly at the target position.

25. A railway vehicle, comprising a chassis; and a suspension system including:

a hub assembly configured to travel along a track;

a suspension element coupling the hub assembly to the chassis;

an actuator configured to selectively engage at least one of the chassis and the suspension element; and a processing circuit configured to:

determine a target actuation profile for the chassis using a characteristic of the track at a target position, wherein the target position is selected based on a particular upcoming position of the railway vehicle; and engage the actuator based on the target actuation profile such that a movement of the chassis is controlled based on the particular upcoming position of the railway vehicle and the characteristic of the track.

26. The railway vehicle of claim 25, wherein the actuator is configured to selectively disengage at least one of the chassis and the suspension element.

27. The railway vehicle of claim 25, wherein the target position is proximate a position of the hub assembly.

28. The railway vehicle of claim 25, wherein the target position is ahead of a position of the hub assembly.

29. The railway vehicle of claim 25, wherein the processing circuit is configured to determine the target actuation profile based on a threshold value.

30. The railway vehicle of claim 29, wherein the threshold value includes an oscillation amplitude.

31. The railway vehicle of claim 29, wherein the threshold value includes an oscillation direction.

32. The railway vehicle of claim 29, wherein the threshold value includes an oscillation frequency.

33. The railway vehicle of claim 29, wherein the threshold value includes a rate associated with the movement of the chassis.

34. The railway vehicle of claim 29, wherein the threshold value includes an acceleration associated with the movement of the chassis.

35. The railway vehicle of claim 29, wherein the threshold value includes a jerk associated with the movement of the chassis.

* * * * *